US008831492B2

(12) United States Patent
Nagata

(10) Patent No.: US 8,831,492 B2
(45) Date of Patent: Sep. 9, 2014

(54) IMAGE HEATING APPARATUS

(71) Applicant: Canon Kabushiki Kaisha, Tokyo (JP)

(72) Inventor: Teppei Nagata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 13/647,839

(22) Filed: Oct. 9, 2012

(65) Prior Publication Data

US 2013/0108335 A1 May 2, 2013

(30) Foreign Application Priority Data

Oct. 27, 2011 (JP) ..... 2011-235823

(51) Int. Cl.
*G03G 15/20* (2006.01)

(52) U.S. Cl.
CPC ..... *G03G 15/2028* (2013.01); *G03G 15/2075* (2013.01); *G03G 15/2085* (2013.01)
USPC ..... 399/323; 399/327

(58) Field of Classification Search
CPC ..... G03G 15/2025; G03G 15/2028
USPC ..... 399/323, 327
See application file for complete search history.

(56) References Cited

U.S. PATENT DOCUMENTS

| | | | | |
|---|---|---|---|---|
| 7,133,633 | B2 | 11/2006 | Fukuda et al. | |
| 7,224,922 | B2 | 5/2007 | Kemmochi | |
| 7,460,821 | B2 * | 12/2008 | Ai et al. | 399/328 |
| 7,548,718 | B2 * | 6/2009 | Kubota et al. | 399/329 |
| 8,204,419 | B2 * | 6/2012 | Urano | 399/328 |
| 2005/0013638 | A1 | 1/2005 | Fukuda et al. | |
| 2005/0185978 | A1 | 8/2005 | Kemmochi | |
| 2009/0110449 | A1 * | 4/2009 | Saito et al. | 399/328 |
| 2010/0215413 | A1 * | 8/2010 | Nakajima | 399/323 |

FOREIGN PATENT DOCUMENTS

| | | | |
|---|---|---|---|
| JP | 2-208679 | A | 8/1990 |
| JP | 2005-037567 | A | 2/2005 |
| JP | 2005-266785 | A | 9/2005 |
| JP | 2008-262228 | A | 10/2008 |
| JP | 2011191450 | A * | 9/2011 |

* cited by examiner

*Primary Examiner* — Clayton E Laballe
*Assistant Examiner* — Leon W Rhodes, Jr.
(74) *Attorney, Agent, or Firm* — Fitpatrick, Cella, Harper & Scinto

(57) ABSTRACT

An image heating apparatus, including: a heat rotary member configured to heat an image on a recording material; a rubbing rotary member configured to rub the heat rotary member; a separation plate configured to separate the recording material from the heat rotary member; and a first and a second contact member which are in contact with the heat rotary member to position the separation plate with a predetermined gap from the heat rotary member, wherein, in a width direction of the heat rotary member, the first and second contact members are out of contact with the heat rotary member within a range in which the rubbing rotary member rubs the heat rotary member, and are in contact with the heat rotary member outside the range, and wherein the first and second contact members are in contact with on one end and the other end of the heat rotary member, respectively.

19 Claims, 5 Drawing Sheets

IMAGE HEATING APPARATUS

BACKGROUND OF THE INVENTION

1. Field of the Invention

The present invention relates to an image heating apparatus mounted to an image forming apparatus such as a copying machine, a printer, and a facsimile so that an image on a recording material is heated. In particular, the present invention relates to an image heating apparatus including a rubbing rotary member configured to rub a heat rotary member configured to heat an image on a recording material.

2. Description of the Related Art

Conventionally, there has been used an image heating apparatus including a heat rotary member and a nip forming member configured to form a nip to heat an image on a recording material.

However, some recording materials have projections formed on edges (cut end surfaces) of the recording materials. When such recording materials pass through a nip, the edges of the recording materials may slightly scratch the heat rotary member. In a width direction orthogonal to a direction in which the recording materials are conveyed, portions through which the edges of the recording materials pass converge on a certain point, and hence minute scratches may be locally formed by the cut end surfaces. As a result, glossiness in an image becomes uneven.

As a countermeasure against scratches due to the cut end surfaces, Japanese Patent Application Laid-Open No. 2005-266785 discloses a method of rubbing the heat rotary member with a rubbing member.

By the way, the recording material may wrap around the heat rotary member after passing through the nip, which leads to a risk of a failure of separation. In order to prevent the failure of separation of the recording material, it is effective to use a separation plate configured to separate the recording material. Japanese Patent Application Laid-Open No. 2005-037567 discloses a structure including a plurality of contact members which come into contact with a surface of the heat rotary member so that a distance between the separation plate and the heat rotary member is determined.

However, when grinding dust of the rubbing member surface comes into contact with the contact members, a position of the separation plate may come unstable.

SUMMARY OF THE INVENTION

The present invention provides an image heating apparatus which prevents grinding dust of a rubbing rotary member from adhering to a contact member and preventing a distance between a separation plate and a heat rotary member from becoming unstable.

According to an exemplary embodiment of the present invention, there is provided an image heating apparatus, including: a heat rotary member configured to heat an image on a recording material at a nip; a nip forming member configured to form the nip together with the heat rotary member; a rubbing rotary member configured to rub the heat rotary member; a separation plate provided with a predetermined gap between the heat rotary member and the separation plate, and configured to separate the recording material from the heat rotary member; and a first and a second contact member which are in contact with the heat rotary member so that the separation plate is positioned with the predetermined gap from the heat rotary member, wherein, in a width direction of the heat rotary member, the first contact member and the second contact member are out of contact with the heat rotary member within a range in which the rubbing rotary member rubs the heat rotary member, and are in contact with the heat rotary member outside the range in which the rubbing rotary member rubs the heat rotary member, and wherein the first contact member is in contact with the heat rotary member on one end side in the width direction of the heat rotary member, and the second contact member is in contact with the heat rotary member on the other end side in the width direction of the heat rotary member.

Further features of the present invention will become apparent from the following description of exemplary embodiments with reference to the attached drawings.

DESCRIPTION OF THE EMBODIMENTS

Embodiment (Image Forming Apparatus)

Figure 2:
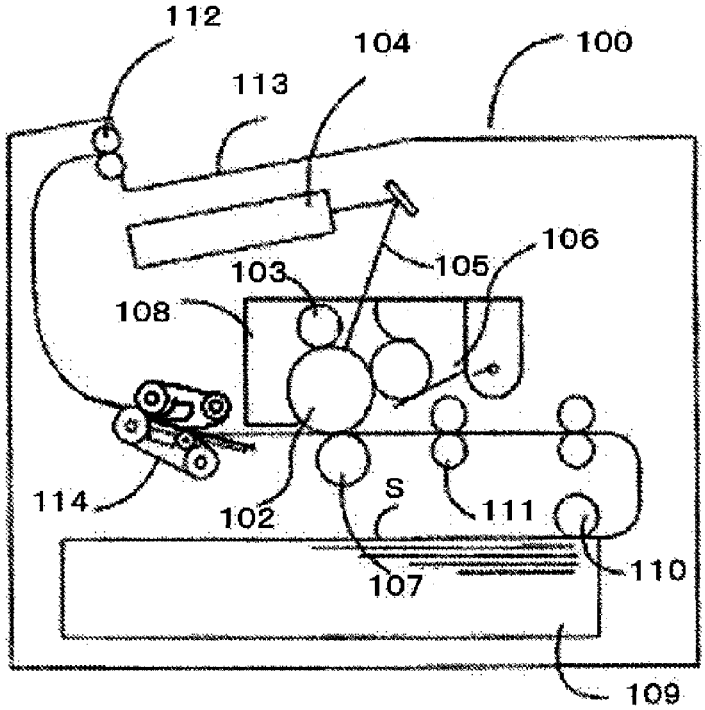
FIG. 2 is a sectional view of an image forming apparatus having the fixing apparatus as the image heating apparatus mounted thereon according to the embodiment.
Figure 3:
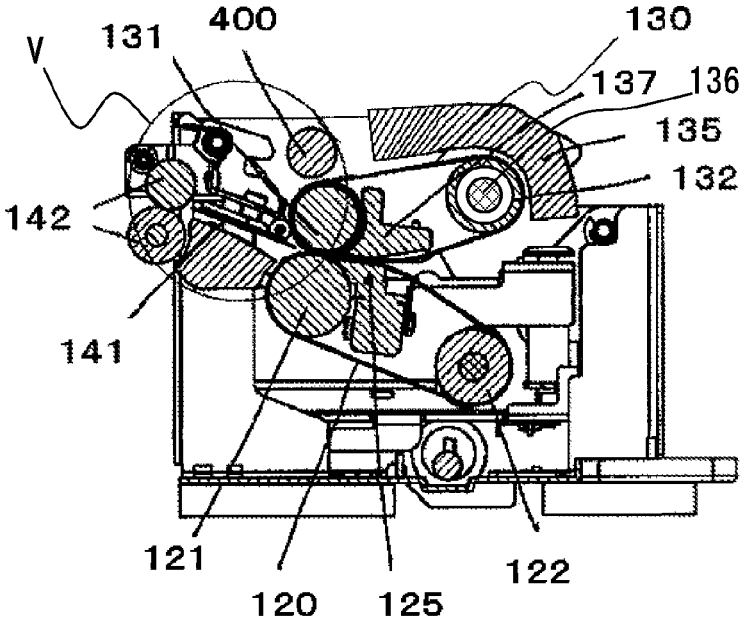
FIG. 3 is a sectional view of the fixing apparatus according to the embodiment.
Figure 4:
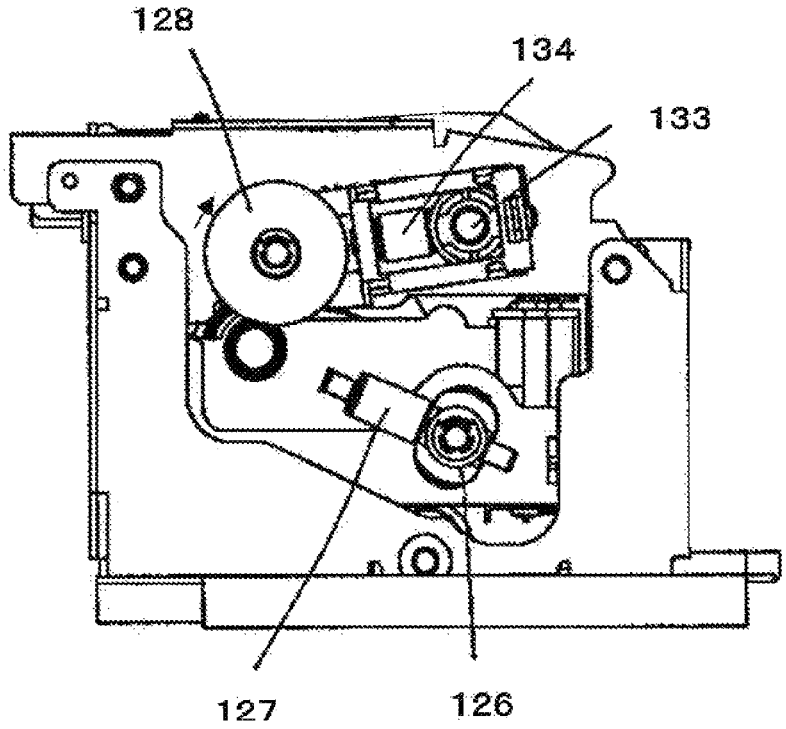
FIG. 4 is a front view of the fixing apparatus according to the embodiment of the present invention.

First, with reference to FIG. 2, an overall structure of an image forming apparatus will be described. The image forming apparatus illustrated in FIG. 2 is an electrophotographic image forming apparatus (what is called a printer). An image forming apparatus 100 mainly includes an image forming unit configured to form a toner image onto a sheet as a recording material, and a fixing apparatus as an image heating apparatus configured to heat and press the toner image formed on the sheet to fix the toner image to the sheet.

The image forming unit includes the following devices. A charger 103 as a charging unit is provided adjacently to a photosensitive drum 102 as an image bearing member. The charger 103 uniformly charges a surface of the photosensitive drum 102. An exposure device 104 as an exposure unit applies a light beam 105 according to the image so as to form an electrostatic latent image on the photosensitive drum 102. A developing device 106 as a developing unit develops the electrostatic latent image so as to form a toner image.

Meanwhile, sheets S are stored in a feeding cassette 109 in a lower portion of the image forming apparatus, and fed by a feed roller 110. The sheet S is conveyed in synchronism with the toner image on the photosensitive drum 102 by a registration roller pair 111 as a conveying unit. The toner image on the photosensitive drum 102 is electrostatically transferred onto the sheet S by a transfer roller 107 as a transfer unit, and the sheet S is conveyed to a fixing apparatus 114. After that, residual toner on the photosensitive drum 102 is removed by a cleaning device 108 as a cleaning unit.

Then, the toner image formed on the sheet S by the image forming unit is fixed to the sheet S by being heated and pressed by the fixing apparatus 114 as the image heating apparatus. After that, the sheet S to which the toner image is fixed is conveyed and delivered by a delivery roller pair 112 onto a delivery tray 113 in an upper portion of the image forming apparatus.

(Image Heating Apparatus)

Next, with reference to FIGS. 3 to 6 and 7A and 7B, the fixing apparatus 114 as the image heating apparatus will be described. A heat belt 130 as a heat rotary member is passed over two supporting rolls as a plurality of belt suspension members, with predetermined tension (for example, at 200 N) so as to be circularly rotatable. The two supporting rolls comprise a drive roll 131 and a tension roll 132 which has a function to apply belt tension to the heat belt 130.

Further, a pressure belt 120 as a nip forming member configured to form a nip portion together with the heat rotary member is passed over two supporting rolls, with predetermined tension (for example, at 200 N) so as to be circularly rotatable. The two supporting rolls comprise a pressure roll 121 and a tension roll 122 which has a function to apply belt tension to the pressure belt 120.

The pressure belt 120 and the heat belt 130 are each formed of an endless belt. The pressure belt 120 is in pressure contact with the heat belt 130 so as to nip and convey the recording material bearing an image through the nip portion. The nip forming member is rotatable about a predetermined position so that the pressure belt 120 is separable from and in contact with the heat belt 130 when image heating is not performed. The structure which performs such a contact-separation operation of the nip forming member composes a first pressure unit.

In the embodiment, any belt may be appropriately selected as the pressure belt 120 as long as the belt has heat resistance. For example, there may be used a belt obtained by coating a nickel metal layer having a thickness of 50 μm, a width of 380 mm, and a circumferential length of 200 mm, for example, with silicone rubber having a thickness of 300 μm, and further coating a surface layer of the silicone rubber with a PFA tube. The PFA refers to tetrafluoroethylene/perfluoroalkylvinylether copolymer.

Figure 1A:
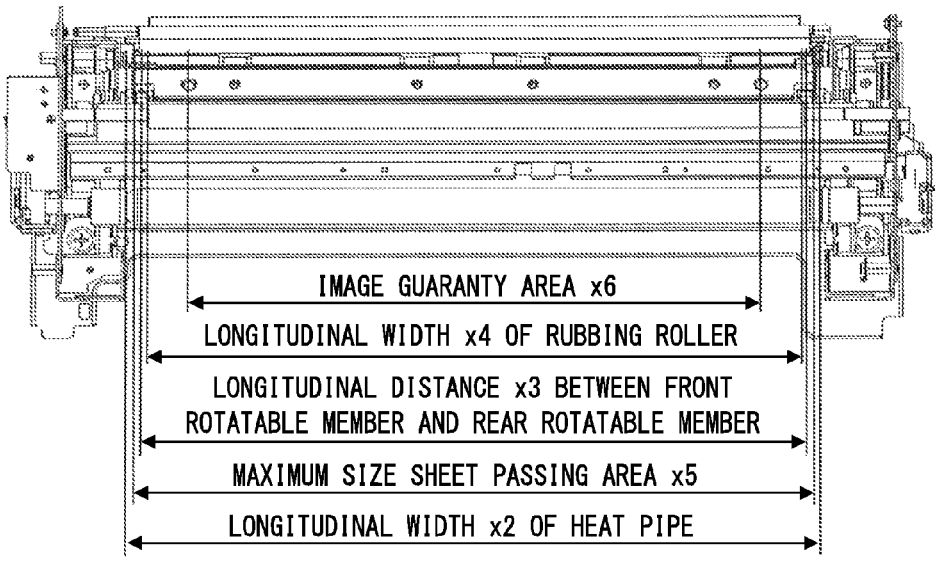
FIGS. 1A and 1B are each a top view illustrating arrangement in a width direction of a fixing apparatus as an image heating apparatus according to an embodiment of the present invention.
Figure 1B:
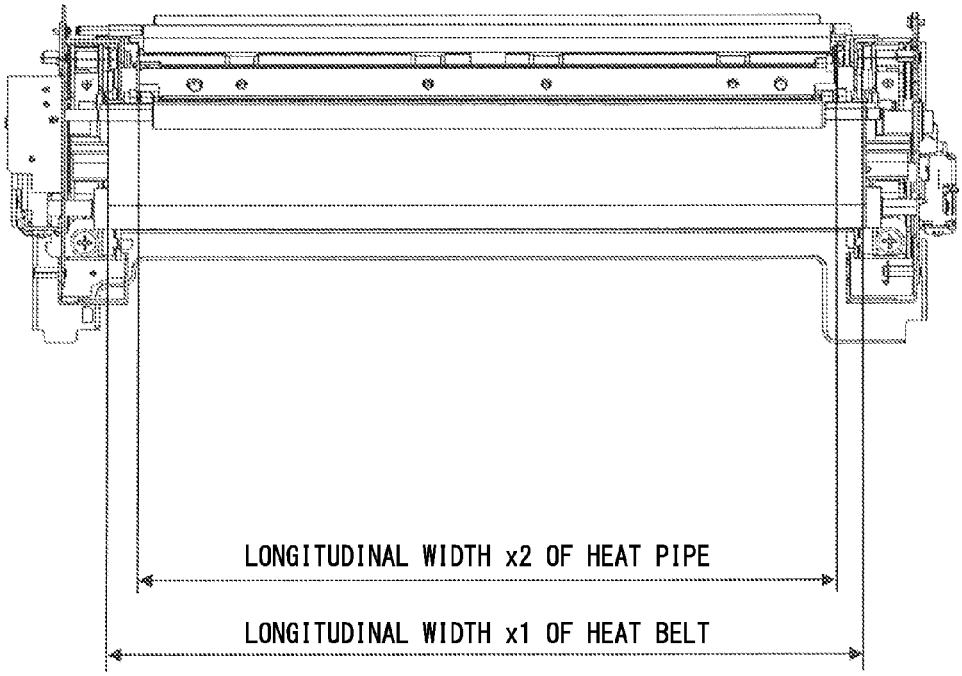

As the heat belt 130, any belt may be appropriately selected as long as the belt can be heated by an induction heating coil 135 and the belt has heat resistance. For example, there may be used a belt obtained by coating a magnetic metal layer such as a nickel metal layer or a stainless layer having a thickness of 75 μm, a width of 380 mm, and a circumferential length of 200 mm, for example, with silicone rubber having a thickness of 300 μm, and further coating a surface layer of the silicone rubber with a PFA tube. Here, reference symbol x1 represents a longitudinal width of the heat belt 130 (width in a width direction of the heat belt) (FIG. 1B). The term "width direction" herein refers to a direction orthogonal to a direction in which the recording material is conveyed. Note that, a cleaning mechanism configured to clean the heat belt 130 is omitted in the embodiment.

The heat belt 130 gradually shifts toward one side along with rotation. As a countermeasure, alignment is changed by a lateral movement controlling unit (not shown) configured to control movement in the width direction of the heat belt 130. In this way, a conveying direction of the heat belt 130 is changed to prevent end portions of the heat belt 130 from being broken by rubbing against other members. A maximum shift amount of the heat belt 130 is set, for example, to 3 mm. The longitudinal width x1 of the heat belt 130 includes the maximum shift amount. The same applies to the pressure belt 120.

On an inner side of the pressure belt 120 at a position corresponding to an inlet side of a nip area between the pressure belt 120 and the heat belt 130 (upstream side of the pressure roll 121), a pressure pad 125 made, for example, of silicone rubber is pressed against the pressure belt 120 with predetermined pressure (for example, at 400 N). The pressure pad 125 forms the nip together with the pressure roll 121. The pressure roll 121 is a roll made, for example, of solid stainless steel at an outside diameter of 20 mm, and suspends the pressure belt 120. The pressure roll 121 is arranged on an outlet side of the nip area between the pressure belt 120 and the heat belt 130.

The tension roll 122 is a hollow roll made, for example, of stainless steel and having an outside diameter of approximately 20 mm and an inside diameter of approximately 18 mm. The tension roll 122 serves as a belt stretching roll. Bearings 126 illustrated in FIG. 4 respectively support both end portions of the tension roll 122 while applying tension of 20 kgf to the pressure belt 120 by tension springs 127.

On an inner side of the heat belt 130 at a position corresponding to the inlet side of the nip area between the heat belt 130 and the pressure belt 120 (upstream side of the drive roll 131), there is provided a pad stay 137 made, for example, of stainless steel (SUS material). The pad stay 137 is pressed against the pressure pad 125 at a predetermined pressure (for example, at 400 N), and forms the nip together with the drive roll 131.

The drive roll 131 is a roll formed by molding a surface layer of a core metal, which is made, for example, of solid stainless steel and has an outside diameter of 18 mm, integrally with a heat-resistant silicone rubber elastic layer. The drive roll 131 is arranged on the outlet side of the nip area between the heat belt 130 and the pressure belt 120 so that an elastic layer thereof is elastically deformed by a predetermined amount by a pressure of the pressure roll 121.

Further, the tension roll 132 is a hollow roll made, for example, of stainless steel and having an outside diameter of approximately 20 mm and an inside diameter of approximately 18 mm. The tension roll 132 serves as a belt stretching roll. Bearings 133 illustrated in FIG. 4 respectively support both end portions of the tension roll 132 while applying tension of 20 kgf to the heat belt 130 by tension springs 134.

A heat pipe 136 is provided inside the tension roll 132, and has a function of a temperature equalizing member configured to equalize a temperature in the width direction of the heat belt 130 (longitudinal temperature uniformity). Any pipe may be appropriately selected as the heat pipe 136 as long as the pipe has heat resistance. For example, there may be used a heat pipe having an outside diameter of approximately 16 mm and a width of approximately 350 mm. Here, reference symbol x2 represents a longitudinal width of the heat pipe 136.

A driving force is input from an outside by a motor (not shown) to the drive roll 131 through a gear 128 (FIG. 4), and the heat belt 130 is rotated by rotation of the drive roll 131. In order to stably convey the sheet as the recording material, the drive is reliably transmitted between the heat belt 130 and the drive roll 131. The heat belt 130 is heated by the induction heating coil 135 and adjusted at a temperature of 180° C. by a temperature detecting unit (not shown) and a controlling unit (not shown).

(Separation Plate)

Figure 5:
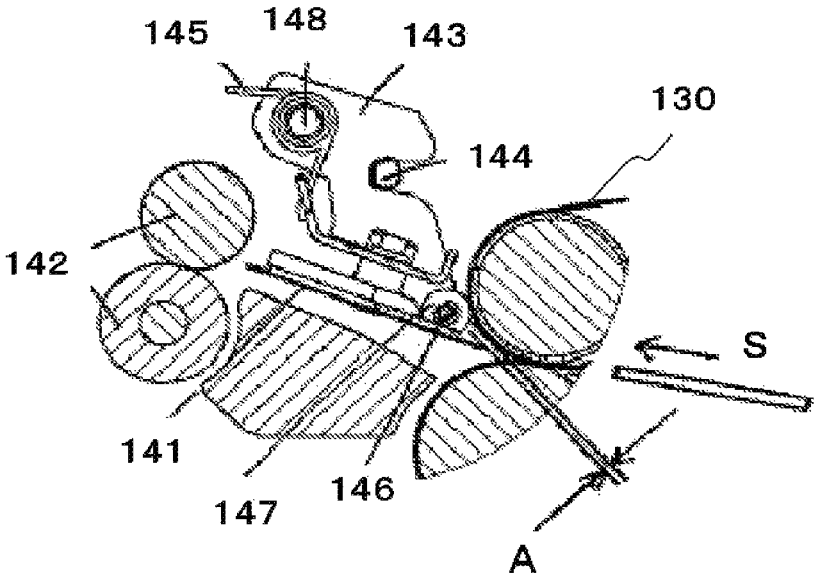
FIG. 5 is a detailed view of a vicinity of a separation plate of the fixing apparatus according to the embodiment.

Next, with reference to FIGS. 5, 6, 6A, 6B, 8A, and 8B, structures of a separation plate and a spacer (contact member) as auxiliary units for separating the sheet in the fixing apparatus according to the embodiment will be described. FIG. 5 is an enlarged view of an encircled portion V of FIG. 3. An end portion of a separation plate 141 on the upstream side in the sheet conveying direction is arranged close to the heat belt 130, and the other end thereof serves as a guide member configured to guide the sheet to a sheet delivery roll pair 142 on a downstream side of the fixing apparatus 114. A gap A (FIG. 5) between the separation plate 141 and the heat belt 130 is set to 0.5 mm. The separation plate 141 is supported by a separation plate holder 143 (supporting member).

The separation plate holder 143 is supported to be rotatable about a separation plate rotation central shaft 144 bridged between both the end portions in the width direction of the heat belt 130, and is pressurized by springs 145 in a direction in which an edge of the separation plate 141 comes close to the heat belt 130. The springs 145 are mounted on bosses 148 provided on the separation plate holder 143.

Figure 6:
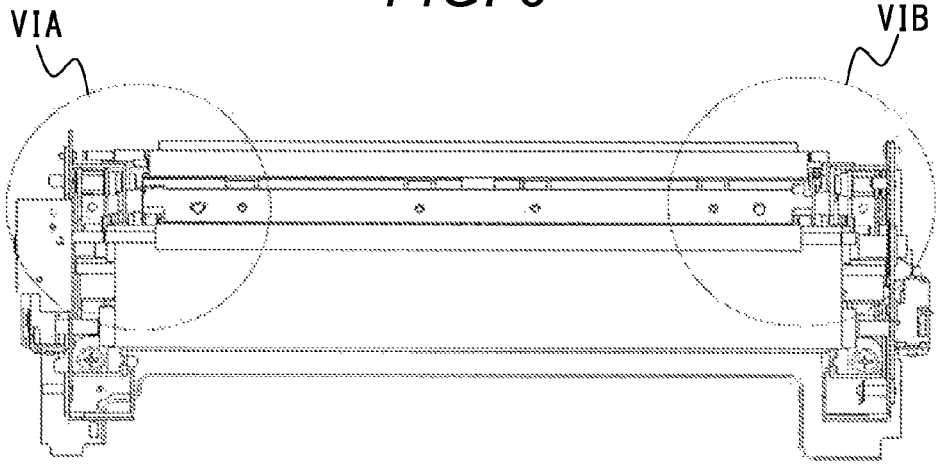
FIG. 6 is an explanatory top view of a vicinity of a spacer member of the fixing apparatus according to the embodiment.
Figure 6A:
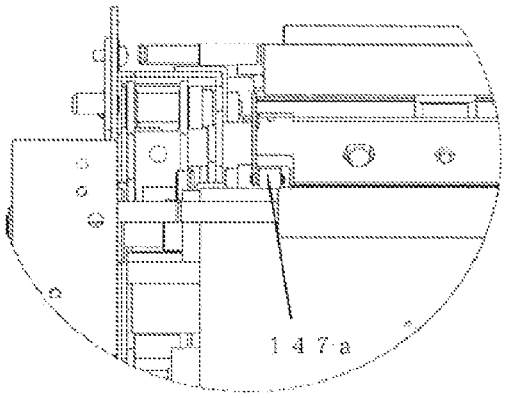
FIG. 6A is an enlarged view of an encircled portion VIA of FIG. 6.
Figure 6B:
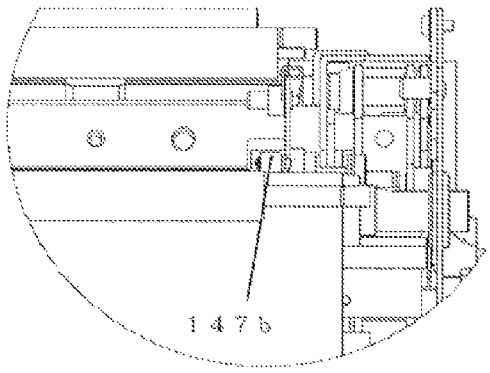
FIG. 6B is an enlarged view of an encircled portion VIB of FIG. 6.
Figure 8A:
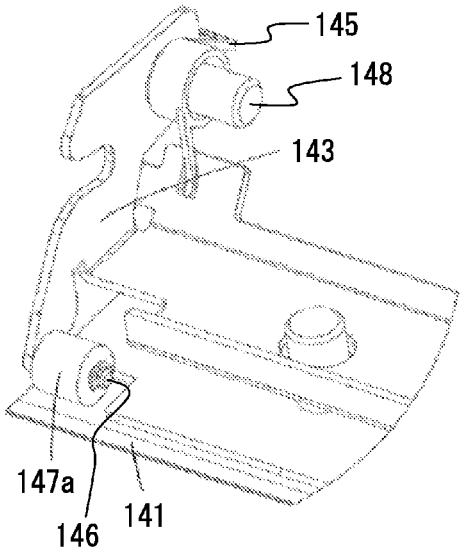
FIGS. 8A and 8B are views of illustrating a separation plate holder.
Figure 8B:
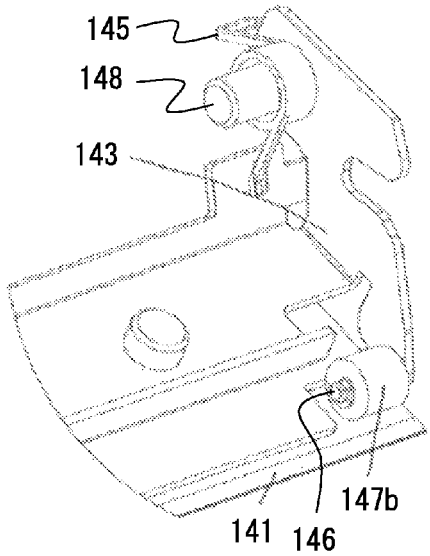

FIG. 6A is an enlarged view of an encircled portion VIA of FIG. 6, and FIG. 6B is an enlarged view of an encircled portion VIB of FIG. 6. FIGS. 8A and 8B illustrate a relationship of the separation plate holder 143, the separation plate 141, and rotatable members 147*a* and 147*b*.

At both ends of the separation plate holder 143 in the width direction, there are respectively and independently arranged shafts 146, and a front rotatable member 147*a* (first contact member) and a rear rotatable member 147*b* (second contact member) as spacers (contact members) supported to be rotatable respectively about the shafts 146 (in other words, the rotatable members 147*a* and 147*b* are arranged at predetermined positions with respect to the separation plate 141). The separation plate 141 is fixed to the separation plate holder 143 by screws and supported by the separation plate holder 143. Respectively on both the end sides of the separation plate holder 143 in the width direction, the rotary shafts 146 for respectively supporting the rotatable members to be rotatable, and the rotatable members (front rotatable member 147*a* and rear rotatable member 147*b*) supported to be rotatable respectively about the rotary shafts 146 are arranged.

In the width direction, positions at which the rotatable members 147*a* and 147*b* come into contact with the heat belt 130 are located on the inside of positions at which both ends of the separation plate 141 oppose to the heat belt 130. The rotatable members 147*a* and 147*b* are arranged on an opposite side of a guide surface of the separation plate 141, along which the recording material is guided. Thus, the rotatable members 147*a* and 147*b* do not hinder conveyance of the recording material.

In the width direction, a range in which the heat belt 130 opposes to the separation plate 141 is wider than a range in which the heat belt 130 comes into contact with a maximum size recording material. Further, in the width direction, both ends of the range in which the heat belt 130 opposes to the separation plate 141 are positioned on the outside of both ends of the range in which the heat belt 130 comes into contact with the maximum size recording material. Thus, recording materials in any size can be highly effectively separated.

In the width direction, the range in which the heat belt 130 comes into contact with the maximum size recording material is narrower than a range in which the heat belt 130 opposes to the heat pipe 136. Further, in the width direction, both the ends of the range in which the heat belt 130 comes into contact with the maximum size recording material are positioned on the inside of both ends of the range in which the heat belt 130 opposes to the heat pipe 136. The rotatable members 147*a* and 147*b* as spacers (contact members) each have a function to determine the gap A between the separation plate 141 and the heat belt 130. Note that, in the embodiment, the separation plate holder 143 is formed by combination of a plurality of metal plates, but the present invention is not limited thereto. The separation plate holder 143 may be formed of a single metal plate.

The rotatable members 147*a* and 147*b* are each formed of a bearing, and abut against the heat belt 130 having the surface layer covered with the PFA tube while being prevented from rubbing against the heat belt 130. The rotatable members 147*a* and 147*b* are each held in contact with and pressurized against the heat belt 130 due to a spring force of the springs 145 (for example, at 0.5 N). The rotatable member 147*a* is defined as a front rotatable member and the rotatable member 147*b* is defined as a rear rotatable member, and reference symbol x3 represents a longitudinal distance between the front rotatable member 147*a* and the rear rotatable member 147*b* (distance between rotatable members provided at a plurality of positions in the width direction of the heat belt 130) (FIG. 1A).

With the structure described above, the separation plate 141, the separation plate holder 143, the shafts 146, the front rotatable member 147*a*, and the rear rotatable member 147*b* are integrally rotatable about the separation plate rotation central shaft 144. The edge of the separation plate 141 on the side of the heat belt 130 can be positioned with high accuracy in accordance with a change of the thickness of the heat belt 130 and a positional change of the surface of the heat belt 130 due to thermal expansion of the heat belt 130 itself and the drive roll 131.

(Rubbing Roller)

Figure 7A:
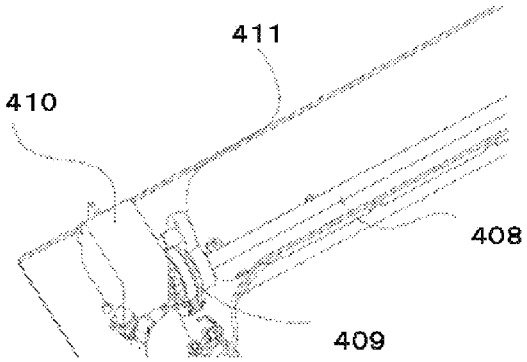
FIG. 7A is an explanatory partial perspective view of a roughening mechanism of the fixing apparatus according to the embodiment.
Figure 7B:
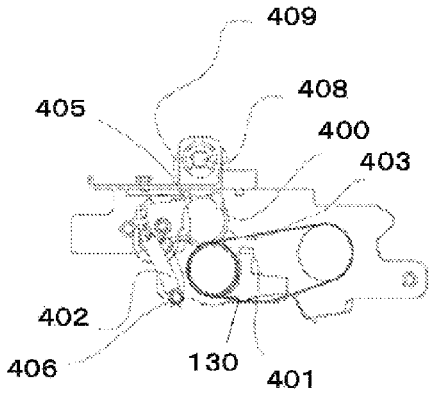
FIG. 7B is a partial sectional view of the roughening mechanism.

Next, with reference to FIGS. 7A and 7B, a rubbing roller as a rubbing rotary member (rubbing member) for maintaining uniform surface roughness of the heat belt 130 of the fixing apparatus according to the embodiment will be described. A rubbing roller 400 is provided to rub the heat belt 130 so that surface properties of the heat belt 130 are restored within a predetermined rubbing area extending in the width direction of the heat belt 130. Note that, the letters "RF" given to names of the following members are an abbreviation for the term "Refresh."

The rubbing roller 400 is supported to be rotatable through bearings by RF supporting arms 402 supported to be rotatable about a fixed shaft bridged between side plates. The rubbing roller 400 is rotated reversely to the heat belt 130 by being driven through an RF drive gear 401 fixed at an end portion of the drive roll 131 and an RF gear 403 fixed at an end portion of the rubbing roller 400.

Further, when the heat belt 130 is pressed against the rubbing roller 400 through RF pressure springs (not shown), the rubbing roller 400 is brought into pressure contact with the heat belt 130 by being urged by the RF pressure springs (not shown). With this, the rubbing roller 400 having a surface on which a polishing layer is provided has a function to uniformly roughen the surface of the heat belt 130 (function to obtain a uniform surface) by being rotated in the same forward direction (one direction in which both the surfaces of the rubbing roller 400 and the heat belt 130 are moved) at a circumferential speed different from that of the heat belt 130. The rubbing roller 400 is formed by bonding, through a bonding layer, abrasive grains with high density to a surface of a stainless core metal having, for example, an outside diameter of approximately 12 mm and a width of approximately 330 mm. Here, reference symbol x4 represents a longitudinal width of the rubbing roller 400 (FIG. 1A).

A granularity of the abrasive grains is changed within a range of from #1,000 meshes to #4,000 meshes conforming to JIS R 6001 depending on use (target glossiness of an image). An average grain size of the abrasive grains with a granularity of #1,000 meshes is approximately 16 μm, and an average grain size of the abrasive grains with a granularity of #4,000 meshes is approximately 3 μm. The abrasive grains are alumina-based (commonly, also referred to as "Alundum™" or "MORUNDUM™") Such alumina-based abrasive grains are most widely used in industrial fields, and are markedly higher in hardness than the surface of the heat belt (hereinafter also referred to as fixing belt) 130 while the grains have an acute shape. Thus, the alumina-based abrasive grains are excellent in polishing property.

The RF supporting arms 402 configured to support the rubbing roller 400 each hold one end of an RF spacing spring 405 having another end held by an RF spacing shaft 406. The rubbing roller 400 is pressed by the RF spacing springs 405 against RF cams fixed to an RF cam shaft 408. An RF contact-separation gear 409 is fixed to the RF cam shaft 408, and the RF cam shaft 408 is rotated in association with rotation of an RF pressure motor 410 through an RF motor gear 411 by a controlling unit (not shown).

With this configuration, when the RF supporting arms 402 are operated in accordance with a profile of the RF cams fixed to the RF cam shaft 408, the rubbing roller 400 can be moved between a pressure position at which a roughening nip is formed, and a spaced position. When the rubbing roller 400 is pressurized, for example, at 10 N, a roughness of a surface roughened to have a roughness Rz (JIS B 0601) of approximately 2.0 μm by a sheet having basis weight of approximately 220 gsm can be restored to Rz of approximately from 0.3 μm to 0.7 μm.

Although not described in detail here, the members described above form a second pressure unit configured to contact the rubbing roller 400 to the heat belt 130 and separate the rubbing roller 400 from the heat belt 130.

Note that, in order to prevent fouling of the surface of the rubbing roller 400, normally, the rubbing roller 400 is separated from the heat belt 130, and is brought into contact with the heat belt 130 so as to rub the surface of the heat belt 130 at every formation of images on a predetermined number of sheets. The controlling unit controls the RF pressure motor 410 so that the rubbing roller 400 is operated in this way.

Note that, in order to reliably yield such a refreshing effect, it is desired that a refreshing operation be performed to satisfy the following formula. $7\times10^{-3}\leq(P/\pi H \tan\theta)\cdot(|V-v|/V)\leq68\times10^{-3}$, where P[N] represents load of the rubbing roller 400 onto the heat rotary member (heat belt 130), V[mm/sec] represents a circumferential speed of the heat belt 130, v[mm/sec] represents a circumferential speed of the rubbing roller 400, H[GPa] represents micro-hardness of the heat belt 130, and θ[°] represents a half angle of the apex of a projecting portion on the surface of the heat belt 130.

As a result, by the operation of the rubbing roller 400, the surface roughness Rz of the heat belt 130 falls within a range of from 0.5 μm to 2.0 μm, and ten or more recessed portions each having a width of 10 μm or less are formed per 100 μm in a rotation axial direction on the heat belt 130 by projecting portions of the rubbing roller 400.

(Arrangement in Width Direction)

With reference to FIGS. 1A and 1B, a longitudinal relationship of the heat belt 130, the heat pipe 136, the front rotatable member 147*a*, the rear rotatable member 147*b*, and the rubbing roller 400 (positional relationship in the width direction of the heat belt 130) will be described. In the description, reference symbol x1 represents the longitudinal width of the heat belt 130, reference symbol x2 represents the longitudinal width of the heat pipe 136, reference symbol x3 represents the longitudinal distance between the front rotatable member 147*a* and the rear rotatable member 147*b*, reference symbol x4 represents the longitudinal width of the rubbing roller 400, reference symbol x5 represents a maximum size sheet passing area through which a maximum size recording material passes, and reference symbol x6 represents an image guaranty area. Longitudinal relationships of these dimensions satisfy the following formula.

The formula x6<x4<x3<x5<x2<x1 is satisfied. The reasons for this will be described below.

First, the reason for arranging both ends of the longitudinal width of the rubbing roller 400 on a longitudinally outside of the image guaranty area (x6<x4) will be described. The rubbing roller 400 is brought into abutment against the surface layer of the heat belt 130 so that the surface roughness of the surface layer of the heat belt 130 is maintained to be uniform. This is because, surface properties of the heat belt 130 are partially deteriorated through repetitive fixing processes, and the deteriorated surface properties of the heat belt 130 are transferred as they are onto image surfaces, which hinders formation of image surfaces having uniform glossiness.

As a countermeasure, by setting the longitudinal width of the rubbing roller 400 to be larger than a width of the image guaranty area (x6<x4), the surface roughness of the surface layer of the heat belt 130 is maintained to be uniform in the image guaranty area. Thus, image surfaces get into a state of uniform glossiness.

Next, the reason for arranging the front rotatable member 147*a* and the rear rotatable member 147*b* on a longitudinally outside of a rubbing area of the rubbing roller 400 (x4<x3) will be described. When the rubbing roller 400 is brought into pressure contact with the heat belt 130 and is rotated, grinding dust of the rubbing roller 400 and toner offset onto the heat belt 130 are generated in a range of the longitudinal width (x4) of the rubbing roller 400. When such grinding dust and offset toner adhere to the front rotatable member 147*a* and the rear rotatable member 147*b*, an edge of the separation plate 141 on the side of the heat belt 130 is spaced away from the surface of the heat belt 130 by heights of the adhering grinding dust and the offset toner on the rotatable members. As a result, a gap between a position of the edge of the separation plate 141 and the heat member cannot be accurately secured.

As a countermeasure, by arranging the front rotatable member 147*a* and the rear rotatable member 147*b* on the longitudinally outside of the rubbing area of the rubbing roller 400 (x4<x3), the grinding dust and the offset toner are prevented from adhering to the front rotatable member 147*a* and the rear rotatable member 147*b*. Thus, the separation plate 141 can be positioned with high accuracy. Note that, in the width direction, within a range in which the heat belt 130 comes into contact with the recording material, the grinding dust adheres to the sheet and is conveyed by the sheet.

Next, the reason for arranging the front rotatable member 147*a* and the rear rotatable member 147*b* on a longitudinally inside of both ends of the heat pipe 136 (x3<x2) will be described. In areas of the heat belt 130 located on the longitudinally outside of both the ends of the heat pipe 136 (x1–x2), the heat belt 130 rises in temperature less uniformly than in the area located on the longitudinally inside of both the ends of the heat pipe 136, and hence the surface of the heat belt 130 significantly changes in position by thermal expansion. When the front rotatable member 147*a* and the rear rotatable member 147*b* are brought into abutment against the areas of the heat belt 130 located on the longitudinal outside of both the ends of the heat pipe 136, the edge of the separation plate 141 on the side of the heat belt 130 is spaced away from the surface of the heat belt 130.

As a countermeasure, by arranging the front rotatable member 147*a* and the rear rotatable member 147*b* on the longitudinally inside of the heat pipe 136 (x3<x2), the front rotatable member 147*a* and the rear rotatable member 147*b* can be brought into abutment against points which are less likely to change in position by thermal expansion of the heat belt 130. Thus, the separation plate 141 can be positioned with high accuracy.

Note that, regarding the longitudinal relationship among the longitudinal distance x3, the longitudinal width x2, and the maximum size sheet passing area x5 (x3<x5<x2), in the embodiment, the front rotatable member 147*a* and the rear rotatable member 147*b* are provided between the separation plate holders 143, and hence the longitudinal distance x3 is smaller than a width of the maximum size sheet passing area x5 (x3<x5). In other words, the front rotatable member 147*a* and the rear rotatable member 147*b* abut against the heat belt 130 in the width direction on the inside of the maximum size sheet passing area x5. Note that, the maximum size sheet passing area x5 falls within the width of the separation plate 141, and hence separability is not deteriorated.

Further, in order to maintain the uniform longitudinal temperature distribution of the heat belt 130 within the area through which the recording material passes, the heat pipe 136 extends over a length larger than at least the maximum size sheet passing area x5 (x5<x2). Therefore, the longitudinal relationship x3<x5<x2 is established.

Lastly, the reason for arranging the heat pipe 136 on the longitudinally inside of both ends of the heat belt 130 (x2<x1) will be described. In the embodiment, it is not necessary in particular to limit the longitudinal relationship between the longitudinal width x1 of the heat belt 130 and the longitudinal width x2 of the heat pipe 136, and hence the longitudinal width x2 of the heat pipe 136 may be larger than the longitudinal width x1 of the heat belt 130. However, the heat pipe 136 is a unit configured to maintain uniformity of the longitudinal temperature distribution of the heat belt 130, and such function of the heat pipe 136 can be reliably carried out as long as x2 is less than x1 (x2<x1). Therefore, the longitudinal relationship x2<x1 is employed.

According to the embodiment, the surface properties of the heat belt 130 can be restored. Further, powder dust generated by grinding of the rubbing roller 400 as the rubbing rotary member (rubbing member) is prevented from adhering to the spacers (contact members), and hence the gap can be more reliably set. Still further, in the width direction of the heat belt 130, when the spacers (contact members) come into contact with the heat belt 130 at the positions on the outside of the region through which the recording material passes, toner offset to the heat belt 130 is prevented from adhering to the spacers (contact members). Also with this, the gap can be more reliably set. When the fixing apparatus described above is used in an image forming apparatus such as an electrophotographic copying machine, the sheet can be stably separated from the heat member.

(First Modification)

In the above-mentioned embodiment, the invention is applied to the belt-type fixing apparatus. However, the heat member and the pressure member are not limited to those using a belt, and a roller may be used. Alternatively, one of the heat member and the pressure member may use a belt while another of the heat member and the pressure member uses a roller. In other words, the invention is applicable to an image heating apparatus in which only one of the heat member and the pressure member uses a belt.

(Second Modification)

In the above-mentioned embodiment, the rotatable members 147*a* and 147*b* as the spacers (contact members) are provided on the separation plate holder 143 configured to hold the separation plate 141. However, the separation plate 141 as a recording material separating unit itself may hold the rotatable members 147*a* and 147*b*. Further, the rotatable members 147*a* and 147*b* may be symmetrically arranged with each other on both end sides, or may be asymmetrically arranged with each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-235823, filed Oct. 27, 2011, which is hereby incorporated by reference herein in its entirety.

What is claimed is:

1. An image heating apparatus, comprising:

a first heating rotary member and a second heating rotary member configured to form a nip portion for heating a toner image on a recording material;

a rubbing rotary member configured to rub the first heating rotary member;

a separation plate configured to separate the recording material from the first heating rotary member; and a first gap keeping member and a second gap keeping member configured to keep a gap between the separation plate and the first heating rotary member, wherein the first gap keeping member is disposed at a first position so as (i) to contact one end portion of the first heating rotary member in a width direction of the first heating rotary member and (ii) not to contact with a rubbing area of which the first heating rotary member is rubbed by the rubbing rotary member in the width direction; and wherein the second gap keeping member is disposed at a second position so as (i) to contact the other end portion of the first heating rotary member in the width direction and (ii) not to contact with the rubbing area of the first heating rotary member in the width direction.

2. An image heating apparatus according to claim 1, wherein each of the first gap keeping member and the second gap keeping member includes a roller configured to contact the first heating rotary member.

3. An image heating apparatus according to claim 1, wherein the first position and the second position are located inside an area at which the first heating rotary member opposes to the separation plate in the width direction.

4. An image heating apparatus according to claim 1, wherein the first position and the second position are located inside of an area at which the first heating rotary member contacts the recording material having a maximum width usable in the image heating apparatus in the width direction.

5. An image heating apparatus according to claim 4, wherein both ends of the separation plate are located outside of an area at which the first heating rotary member contacts the recording material having the maximum width in the width direction.

6. An image heating apparatus according to claim 1, wherein the first heating rotary member is an endless belt.

7. An image heating apparatus according to claim 6, further comprising a roller configured to rotatable support the endless belt and a heat pipe disposed in the roller, the roller, wherein the first position and the second position are located inside an area at which the first heating rotary member opposes to the heat pipe.

8. An image heating apparatus according to claim 1, further comprising a supporting member configured to support the separation plate, wherein the supporting member supports the first gap keeping member and the second gap keeping member.

9. An image heating apparatus according to claim 1, wherein the first gap keeping member and the second gap keeping member are disposed on an opposite side of a guiding surface at which the separation plate guides the recording material.

10. An image heating apparatus according to claim 1, wherein the first heating rotary member includes a fluorine resin layer at an outer most surface thereof, and wherein the first gap keeping member and the second gap keeping member are in contact with the fluorine resin layer.

11. An image heating apparatus according to claim 1, further comprising a heating portion configured to heat the first heating rotary member.

12. An image heating apparatus according to claim 11, wherein the heating portion includes a coil configured to generate a magnetic flux for induction heating for the first heating rotary member.

13. An image heating apparatus according to claim 1, further comprising a heating portion configured to heat the second heating rotary member.

14. An image heating apparatus according to claim 1, wherein the rubbing rotary member rubs the first heating rotary member so that the surface roughness RZ of the first heating rotary member is 0.5μm or more and 2.0μm or less.

15. An image heating apparatus according to claim 14, wherein the rubbing rotary member includes abrasive grains whose granularity is within a range of from #1,000 meshes to #4,000 meshes at an outer most surface thereof.

16. An image heating apparatus according to claim 14, wherein the rotational direction of the rubbing rotary member is different from that of the first heating rotary member, and the peripheral speed of the rubbing rotary member is different from that of the first heating rotary member.

17. An image heating apparatus according to claim 1, wherein the rubbing rotary member includes abrasive grains whose granularity is within a range of from #1,000 meshes to #4,000 meshes at an outer most surface thereof.

18. An image heating apparatus according to claim 1, further comprising a moving mechanism configured to move the rubbing rotary member between a contact position where the rubbing rotary member and the first heating rotary member contact each other and a separate position where the rubbing rotary member and the first heating rotary member are separated from each other.

19. An image heating apparatus according to claim 18, wherein when the number of image heating operations reaches a predetermined number or more, the moving mechanism moves the rubbing rotary member from the separate position to the contact position.

* * * * *